US008584727B2

(12) United States Patent
Casey et al.

(10) Patent No.: US 8,584,727 B2
(45) Date of Patent: Nov. 19, 2013

(54) APPARATUS FOR PRODUCING CORRUGATED MATERIAL

(75) Inventors: David W. Casey, Salisbury, NC (US); Gregg A. Bryan, Mooresville, NC (US); Karl U. Wuerminghausen, Canton, OH (US)

(73) Assignee: Greif Packaging LLC, Delaware, OH (US)

( * ) Notice: Subject to any disclaimer, the term of this patent is extended or adjusted under 35 U.S.C. 154(b) by 61 days.

(21) Appl. No.: 13/212,504

(22) Filed: Aug. 18, 2011

(65) Prior Publication Data

US 2011/0297323 A1 Dec. 8, 2011

Related U.S. Application Data

(63) Continuation of application No. 13/034,451, filed on Feb. 24, 2011, now Pat. No. 8,460,496.

(60) Provisional application No. 61/309,230, filed on Mar. 1, 2010.

(51) Int. Cl.
*B31F 1/20* (2006.01)

(52) U.S. Cl.
USPC ..... 156/470; 156/523; 156/526; 156/552; 156/580

(58) Field of Classification Search
None
See application file for complete search history.

(56) References Cited

U.S. PATENT DOCUMENTS

| | | | | | |
|---|---|---|---|---|---|
| 3,841,944 | A | * | 10/1974 | Harris, Jr. | 156/504 |
| 4,419,173 | A | * | 12/1983 | Akiyama et al. | 156/470 |
| 5,245,897 | A | | 9/1993 | Arnold et al. | |
| 6,117,381 | A | * | 9/2000 | Cummings | 264/269 |
| 2002/0071937 | A1 | | 6/2002 | Smith et al. | |
| 2007/0144322 | A1 | * | 6/2007 | Niedermeyer | 83/53 |

FOREIGN PATENT DOCUMENTS

JP 55035749 A * 3/1980

* cited by examiner

*Primary Examiner* — Barbara J Musser
(74) *Attorney, Agent, or Firm* — Sand & Sebolt

(57) ABSTRACT

A method and system for automatically changing the flute size in a corrugation process without stopping or slowing the overall corrugation process utilizing a first single-faced web having a first flute size and a second single-faced web having a second flute size. The first single-faced web is conveyed along a track into a double backer forming a first corrugated material. When a flute change sequence is initiated, the single-faced web is cut using a pressurized stream of water such that the single-faced web disengages with the double backer. Generally simultaneously, the second single-faced web is introduced into the double backer using an air jet, wherein a second corrugated material is formed.

11 Claims, 8 Drawing Sheets

APPARATUS FOR PRODUCING CORRUGATED MATERIAL

CROSS REFERENCE TO RELATED APPLICATION

This application is a continuation of U.S. patent application Ser. No. 13/034,451, filed Feb. 24, 2011, now U.S. Pat. No. 8,460,496, which claims priority from U.S. Provisional Application Ser. No. 61/309,230, filed Mar. 1, 2010; the disclosures of which are incorporated herein by reference.

BACKGROUND OF THE INVENTION

1. Technical Field

The invention relates generally to a method and system for producing corrugated material. More particularly, the invention relates to automatically changing a flute size during the corrugation process. Particularly, the invention relates to cutting a single-faced web using a water jet as it travels along a track and into a double backer, while simultaneously introducing another single-faced web into the double backer using an air jet, without stopping or slowing the overall corrugation process and system.

2. Background Information

Corrugated paperboard is manufactured at very fast line speeds in corrugator machines which are well known in the industry. A typical corrugator machine includes at least one single-facer line which forms a single-faced web having a plurality of flutes with a particular flute size. The typical corrugator machine further includes a double backer which applies a second liner to the single-faced web to form a corrugated material, a scoring section for applying score cuts into the corrugated material, and a cutting section to divide the corrugated material into individual pieces.

In the single-facer line, corrugated flutes are formed transversely across a first material to form a corrugated web. A liquid adhesive is then applied to the tips of these flutes and the corrugated web is advanced. After the adhesive is applied, a second material is brought into contact with the glue-coated flutes to form a laminated single-faced web. The single-faced web is then conveyed through a bridge section which accumulates the single-faced web around bridge rollers for future use as needed. After the bridge section the single-faced web passes through a glue unit where an adhesive is delivered to the exposed flute tips of the single-faced web. Thereafter, both the single-faced web and a third material is delivered into the double backer, after which the third material is applied to the exposed side of the single-faced web to form a corrugated material.

Generally, corrugated material is classified depending on the size of the flutes into A, B, C, and E flute classes, which have different heights and pitches, and which are selectively employed depending upon the desired uses. The flute size is determined by two abutting rollers which have their circumferential surfaces machined into a corrugated configuration with the first material being worked into the corrugated web. Inasmuch as these rollers are typically formed of metal which have been machined into the corrugated shape, different flute sizes require that the operator advances the first material through entirely different sets of rollers.

Many motors, sensors, and mechanical and electrical equipment must be started and brought online to begin the corrugation process. Therefore, it is extremely desirable to continuously run the corrugation machine to accomplish multiple jobs in succession. Typically, an entire batch of different jobs is run successively through the corrugation machine once the mechanical and electrical systems are online. Each job may require a different flute size corresponding to the desired finished corrugated material. While multiple single-facer lines are typically employed to provide a selection of flute sizes and single-faced webs, the corrugation process currently has to stop during a flute change sequence to insert the new single-faced web into the double backer. The process of slowing down and speeding up the corrugator machine before and after this stoppage is wholly inefficient as a significant amount of time is wasted, thereby decreasing production rates. Furthermore, the flute change sequence is currently done by hand, which represents a significant safety concern as rotating parts within the double backer are formed to continuously and forcefully pull material into the machine.

Therefore, a need exists for an improved method and system for producing corrugated material in which a user may automatically change the flute size without stopping or slowing down the overall corrugation process.

BRIEF SUMMARY OF THE INVENTION

Changing a flute size in a corrugation machine without stopping or slowing the double backer represents an enormous improvement in the art. Knives or other blade-type cutting tools break or tear the single-faced web when attempting to cut at the fast line speeds typically used in the art. Furthermore, blade-type cutting tools quickly become dull and require frequent replacement. By introducing a water jet cutting device, this problem is eliminated and the single-faced web may now cut at the line speed. Furthermore, by introducing an air table, the single-faced web may now be fed into the double backer without compromising the safety of a user, as previously the single-faced web was manually fed into the double backer during a flute change. By automating the processes of cutting the old single-faced web and feeding the new single-faced web into the double backer, the entire corrugation process may be run at full line speed during a flute change sequence.

The present invention focuses on an improved method and system for producing corrugated material comprising the steps of: forming a single-faced web of corrugated material having a first edge and a spaced apart second edge; conveying the single-faced web along a track; providing an air stream to convey a portion of the single-faced web off the track and towards a double backer; engaging the portion with the double backer, whereby the double backer pulls the single-faced web into the double backer and begins producing a corrugated material; applying a cut through the first edge of the single-faced web to form a cut portion of the single-faced web; stopping conveying of the single-faced web along the track; and continuing to pull the generally immobile single-faced web into the double backer whereby the single-faced web separates completely from the first edge to the second edge generally proximate the cut portion.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

A corrugation system for carrying out the method of the present invention is represented generally at 1, and shown in FIGS. 1-11. As shown particularly in FIG. 1, corrugation system 1 includes a first single facer line 3 and second single facer line 4. Single facer lines 3 and 4 are substantially identical and positioned to operate in a complementary fashion, as discussed in detail below. However, inasmuch as the preferred embodiment of corrugation system 1 includes two single facer lines 3 and 4, corrugation system 1 need not be limited to two single facer lines and the present invention may encompass as many single facer lines as necessary or desired.

Figure 1:
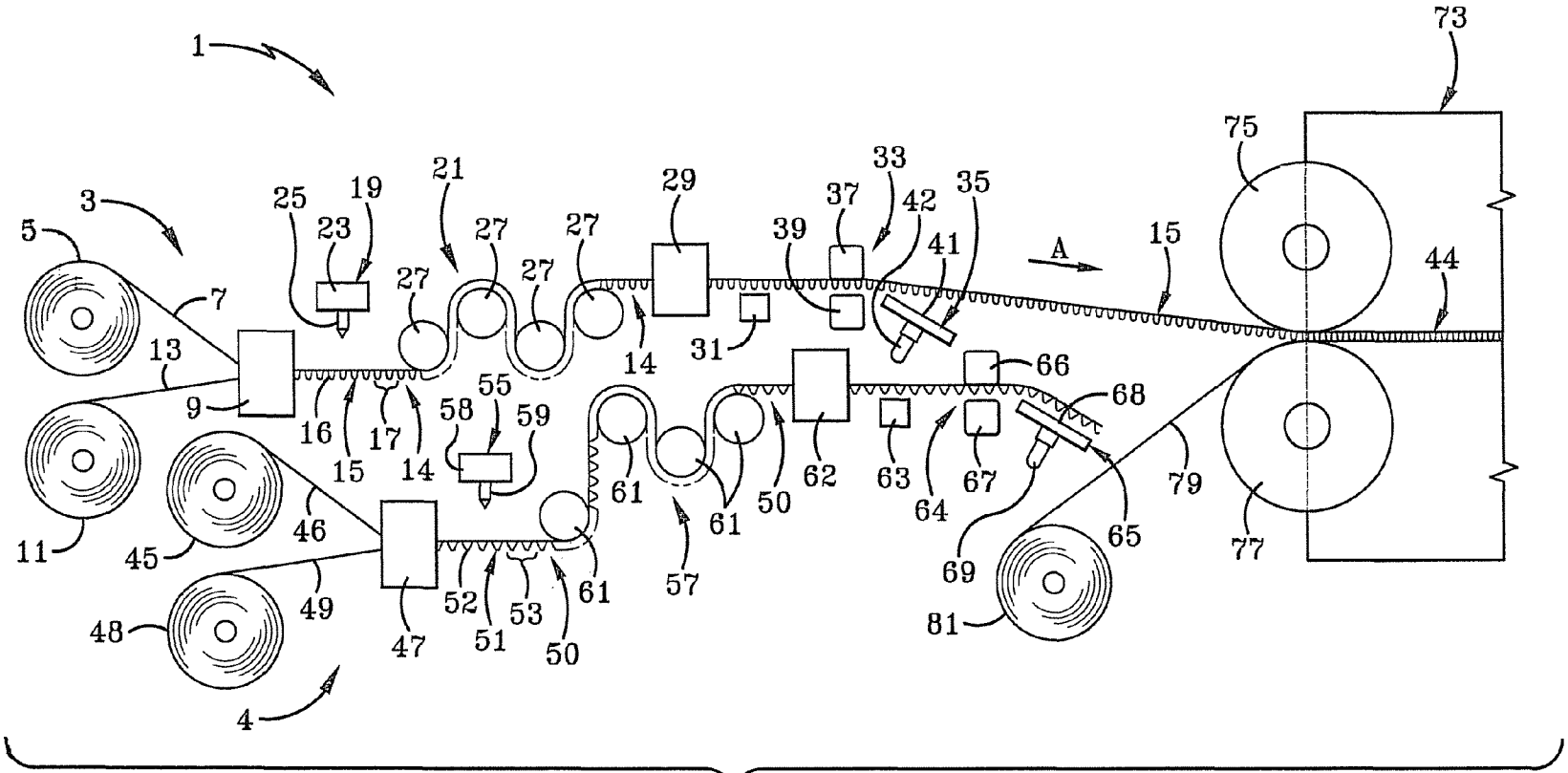
FIG. 1 is a side diagrammatic view of the system for carrying out the method of the present invention, with the first single facer line being conveyed into the double backer and the double backer producing a first corrugated material from the first single-faced web.

As shown in FIG. 1, first single facer line 3 includes a first roll 5 of paper-based material 7 which is rotated off first roll 5 into a single-facer 9. First single facer line 3 further includes a second roll 11 of paper-based material 13 which is rotated off second roll 11 and into single-facer 9. Single-facer 9 forms a first single-faced web 15 of corrugated material out of paper-based materials 7 and 13. First single-faced web 15 includes a first edge 18 and a spaced apart second edge 20 (FIG. 3), and a plurality of flutes 16, each having a uniform flute size 17. Single-facer 9 outputs first single-faced web 15 onto a track 14, which conveys first single-faced web 15 through the remaining portion of first single facer line 3.

Figure 2:
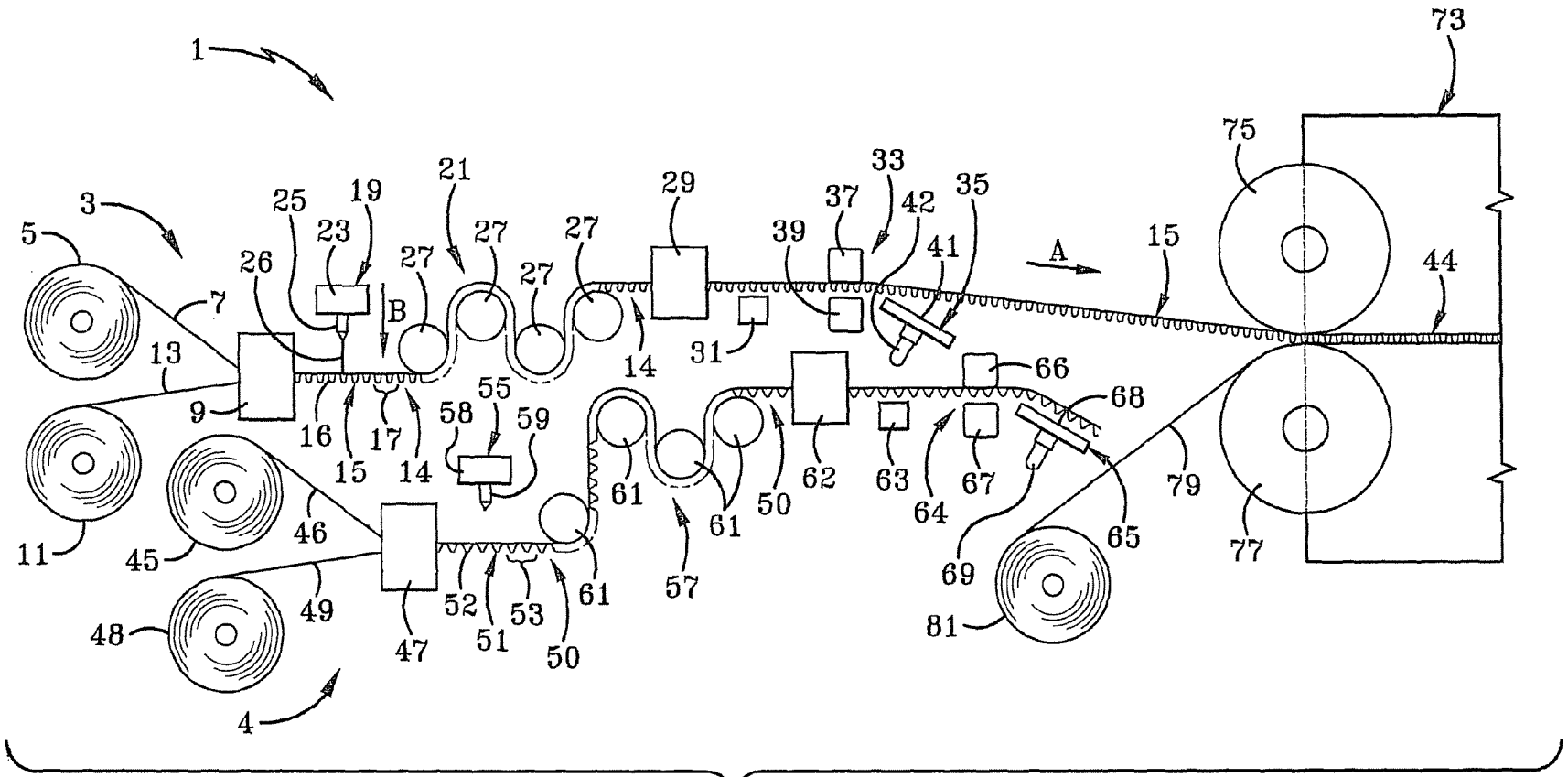
FIG. 2 is a view similar to FIG. 1, with the water jet cutting device expelling a stream of water.
Figure 6:
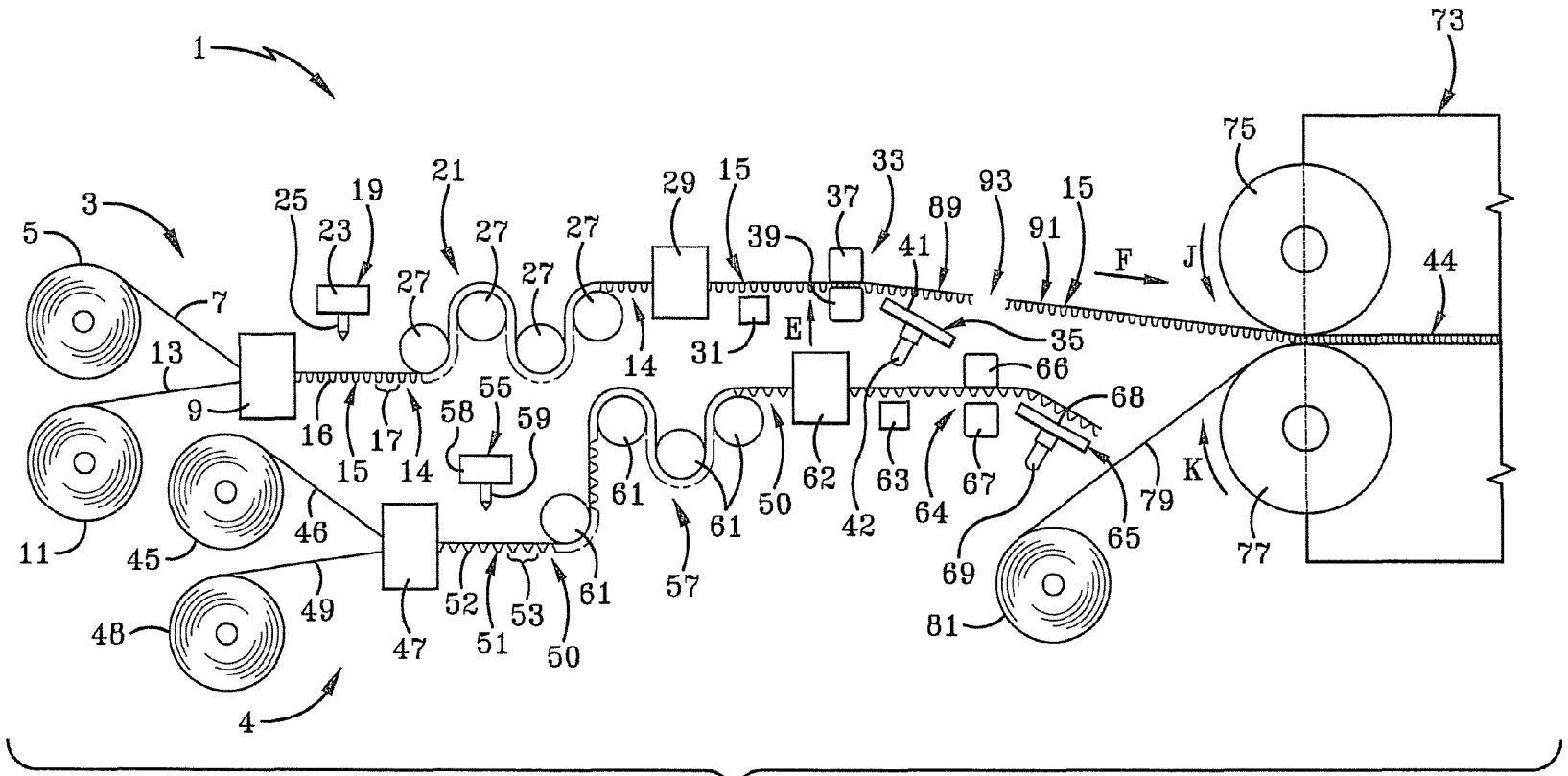
FIG. 6 is a diagrammatic side plan view similar to FIG. 1, with the first single-faced web separated into two portions.

As shown in FIG. 1, first single facer line 3 further includes a water jet cutting device 19, a bridge section 21, a glue unit 29, a sensor 31, a clamp 33, and an air table 35. Water jet cutting device 19 includes a cutting track 23 (FIG. 3) and a nozzle 25 movable along cutting track 23 for delivering a pressurized water stream 26 (FIG. 2). Bridge section 21 includes a plurality of bridge rollers 27 offset from one another and disposed to direct first single-faced web 15 into glue unit 29. A clamp mechanism 33 is movable between an open position (FIG. 1) and a closed position (FIG. 6), and includes a first clamp bar 37 and a second clamp bar 39. In the open position, first clamp bar 37 is distal from second clamp bar 39 (FIG. 1). In the closed position, first clamp bar 37 is proximate second clamp bar 39 (FIG. 6). An air table 35 is located downstream from clamp mechanism 33 and includes a top surface 41 and an air hose 42 connected to an air delivery device (not shown).

As shown in FIG. 1, second single facer line 4 includes a first roll 45 of paper-based material 46 which is rotated off first roll 45 into a single-facer 47. Second single facer line 4 further includes a second roll 48 of paper-based material 49 which is rotated off second roll 48 and into single-facer 47. Single-facer 47 forms a second single-faced web 51 of corrugated material out of paper-based materials 46 and 49. Second single-faced web 51 includes a plurality of flutes 52, each having a uniform flute size 53. Single-facer 47 outputs second single-faced web 51 onto a track 50, which conveys second single-faced web 51 through the remaining portion of second single facer line 4.

As shown in FIG. 1, second single facer line 4 further includes a water jet cutting device 55, a bridge section 57, a glue unit 62, a sensor 63, a clamp mechanism 64, and an air table 65. Water jet cutting device 55 includes a cutting track 58 and a nozzle 59 movable along cutting track 58, and delivers a pressurized stream of water (not shown) similar to water jet cutting device 19. Bridge section 57 includes a plurality of bridge rollers 61 offset from one another and disposed to direct second single-faced web 51 into glue unit 62. Clamp mechanism 64 is movable between an open position and a closed position, and includes a first clamp bar 66 and a second clamp bar 67. In the open position, first clamp bar 66 is distal from second clamp bar 67. In the closed position, first clamp bar 66 is proximate second clamp bar 67. Air table 65 includes a top surface 68 which is formed with a plurality of openings 43 (FIG. 8) to enable an air stream 71 (FIG. 9) to pass through surface 68. Air stream 71 is delivered by an air hose 69 connected to a usual air delivery device (not shown).

As shown in FIG. 1, corrugation system 1 further includes a double backer 73. Double backer 73 includes a first inlet roller 75 and a second inlet roller 77, and is sized and positioned to receive first single-faced web 15 from first single facer line 3, or alternatively second single-faced web 51 from second single facer line 4. Corrugation system 1 further includes a paper-based material 79 which is rotated off a third roll 81 and into double backer 73, wherein material 79 is adhered to first single faced web 15 or second single faced web 51 to form corrugated material 44 or corrugated material 83, respectively.

Figure 11:
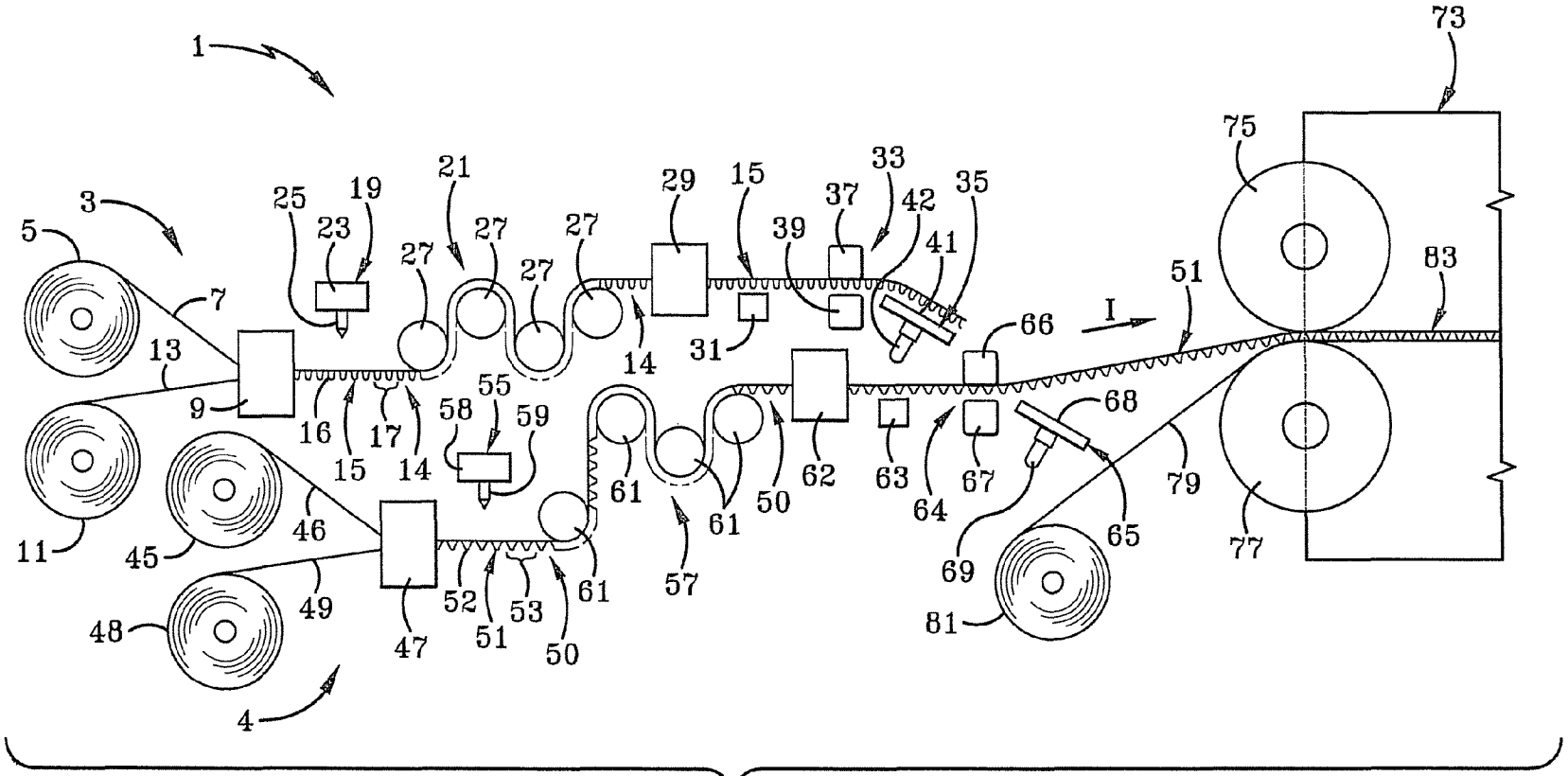
FIG. 11 is a view similar to FIGS. 9 and 10 showing the second single facer line being conveyed into the double backer and the double backer producing a second corrugated material from the second single-faced web.

In operation, either first single-faced web 15 formed by first single facer line 3, or second single-faced web 51 formed by second single facer line 4 is conveyed into double backer 73. Double backer 73 combines either first single-faced web 15 or second single-faced web 51 with material 79 to produce either a corrugated material 44 (FIG. 1) or a corrugated material 83 (FIG. 11). As first single-faced web 15 includes flute size 17, the resulting corrugated material 44 includes flute size 17 (FIG. 1). Likewise, as second single-faced web 51 includes flute size 53, the resulting corrugated material 83 includes flute size 53 (FIG. 11). When the user desires to change which first single-faced web 15 or 51 enters double backer 73, a flute change sequence is initiated whereby the active first single facer line 3 or 4 stops conveying first single-faced web 15 or 51, respectively, into double backer 73. At the same general time, the inactive first single facer line 3 or 4 starts conveying first single-faced web 15 or 51, respectively, into double backer 73.

FIGS. 1-11 illustrate the following flute change sequence from flute size 17 to flute size 53. As shown in FIG. 1, first single facer line 3 is active, conveying first single-faced web 15 into double backer 73, while second single facer line 4 is not active, and not conveying second single-faced web 51 into double backer 73. When a flute change sequence is initiated, a signal is sent to water jet cutting device 19, whereby water jet cutting device 19 cuts across first single-faced web 15 in response to receiving the signal. The signal may be transmitted by a hard-wired system or a wireless system or any system well know in the art. As shown in FIG. 2, when water jet cutting device 19 receives an appropriate signal, water stream 26 is expelled from nozzle 25 in the direction of Arrow B, severing first single-faced web 15.

Figure 3:
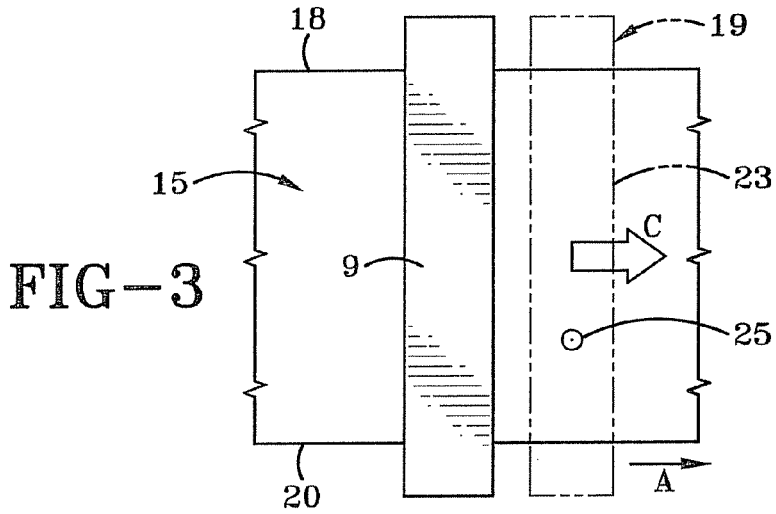
FIG. 3 is a fragmentary top plan view of the single-facer and water jet cutting device of the present invention, with the cutting track shown in phantom.
Figure 4:
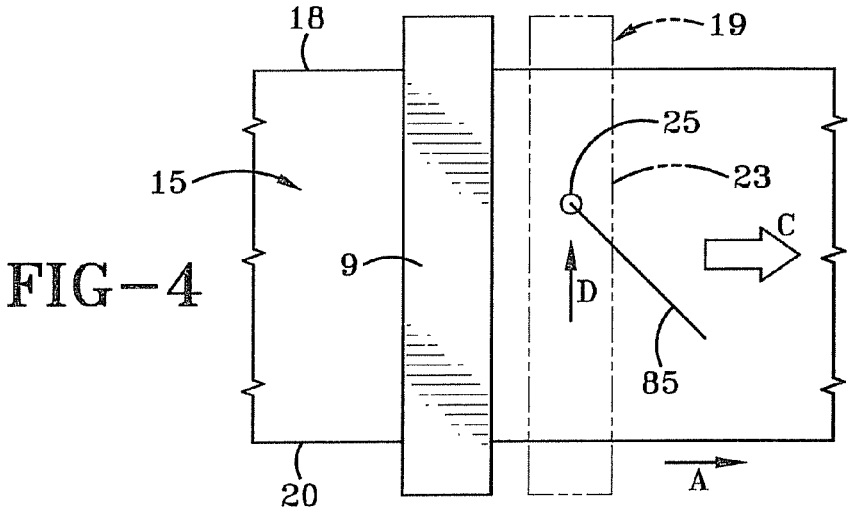
FIG. 4 is a top plan view similar to FIG. 3 with a cut extending through part of the first single-faced web.
Figure 5:
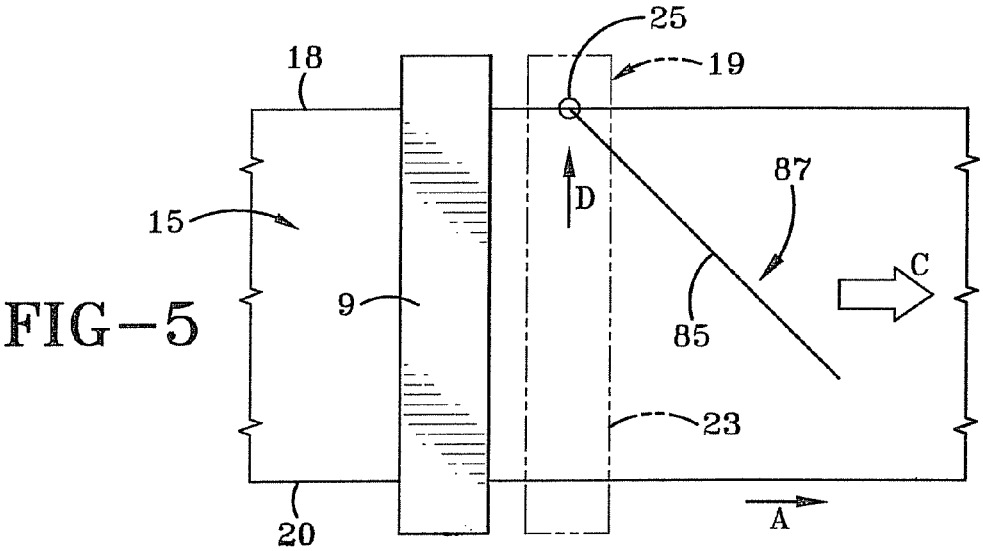
FIG. 5 is a top plan view similar to FIGS. 3 and 4 with the cut extending through the first edge of the first single-faced web.
Figure 7:
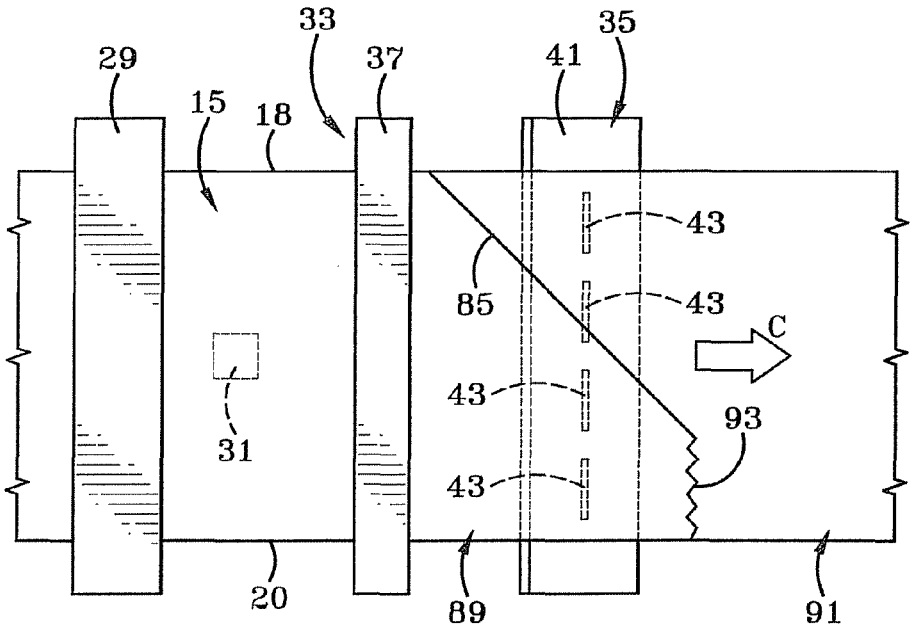
FIG. 7 is a fragmentary top plan view of the glue unit, clamp, and air table of the present invention, with the sensor shown in phantom, and the first single-faced web separated into two portions.
Figure 8:
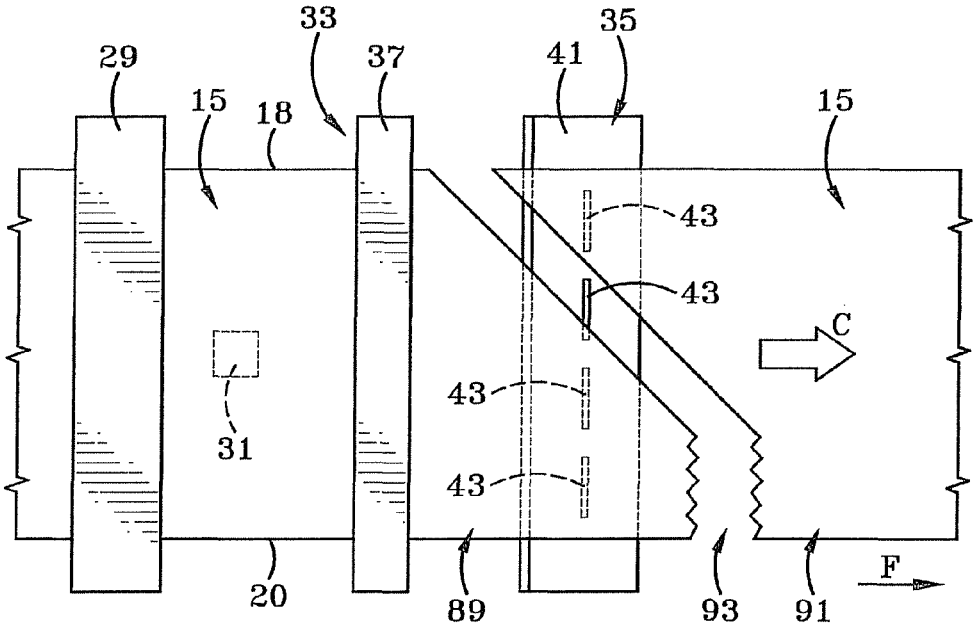
FIG. 8 is a view similar to FIG. 7 with the two separated portions further apart.

As shown in FIGS. 3-5, first single-faced web 15 is cut by water stream 26. Reference Arrow C is shown as a reference for illustrating the relative movement of first single-faced web 15 past water jet cutting device 19. Nozzle 25 is disposed on cutting track 23, whereby cutting track 23 extends over the entire width of first single-faced web 15. As shown in FIG. 3, nozzle 25 is offset from second edge 20 when nozzle 25 begins expelling water stream 26. As shown in FIG. 4, nozzle 25 moves along the cutting track in the direction of Arrow D, continuing to expel water stream 26 through first single-faced web 15. As shown in FIG. 5, nozzle 25 continues to move along cutting track in the direction of Arrow D expelling water stream 26 through first single-faced web 15 until first single-faced web 15 is severed through first edge 18, thereby forming a cut 85 in first single-faced web 15 and disposed in a general cut portion 87 area. As shown in FIGS. 7 and 8, cutting track 23 extends generally perpendicularly to first edge 18 and thus nozzle 25 moves perpendicularly across first single-faced web 15 in the direction of Arrow D when applying cut 85. However, as shown in FIGS. 4 and 5, cut 85 extends generally diagonally from first edge 18 toward second edge 20 as a result of the movement of first single-faced web 15 along track 14, as illustrated by Arrow C.

As shown in FIGS. 6-8, after cut 85 is applied to first single-faced web 15 it continues to be conveyed along track 14 past sensor 31 and through clamp mechanism 33 which is in the open position. Sensor 31 monitors first single-faced web 15 and senses when cut portion 87 passes thereby. When sensor 31 senses that cut portion 87 has passed thereby, a signal is sent to clamp mechanism 33, which then moves from the open position to the closed position. As shown in FIG. 6, to move from the open position to the closed position, second clamp bar 39 moves in the direction of Arrow E to clamp web 15 between second clamp bar 39 and first clamp bar 37 preventing web 15 from being conveyed further along track 14. However, double backer 73 continues to pull the severed portion of first single-faced web 15 in the direction of Arrow F by first inlet roller 75 rotating in the direction of Arrow J and second inlet roller 77 rotating in the direction of Arrow K with first single-faced web 15 being disposed therebetween. The pulling on first single-faced web 15 by double backer 73 increases tension on first single-faced web 15, primarily on cut portion 87 disposed between clamp 33 and double backer 73. The tension increases until a tear 93 is formed in first single-faced web 15 such that first single-faced web 15 separates into a first portion 89 and a separate second portion 91 (FIG. 6), whereby second portion 91 continues through double backer 73 and first portion 89 remains on track 14.

Referring to FIGS. 6-8, it will be readily understood that cut portion 87 is the weakest portion of first single-faced web 15 due to cut 85. As such, sensor 31 and clamp mechanism 33 are operationally connected and configured such that clamp mechanism 33 moves from the open position to the closed position immediately after cut portion 87 passes therethrough to position cut portion 87 intermediate clamp mechanism 33 and double backer 73 (FIG. 6). This ensures a controlled separation of first single-faced web 15 into first portion 89 and second portion 91 at generally the area of cut portion 87.

Figure 9:
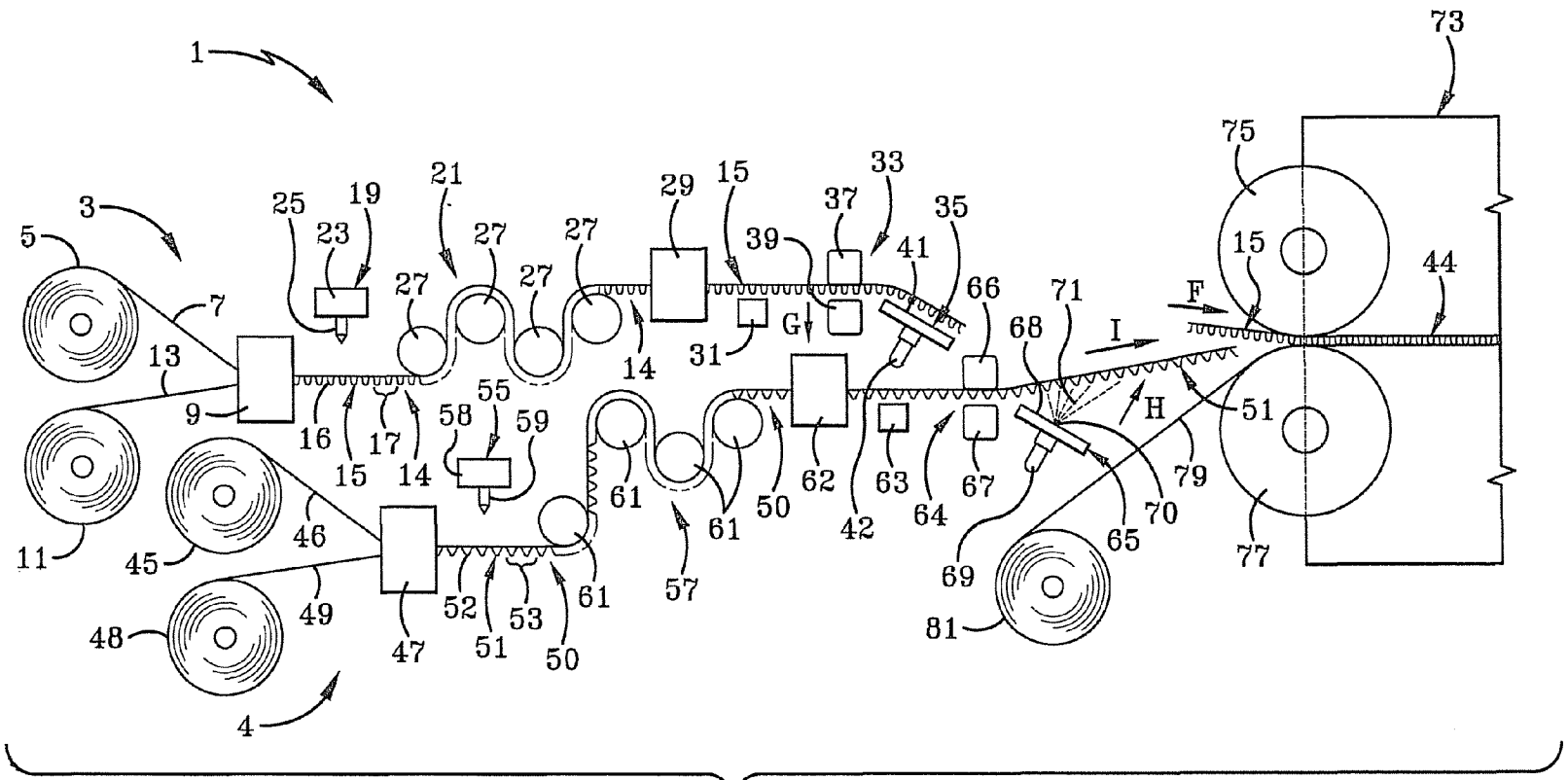
FIG. 9 is a diagrammatic side plan view showing the air table of the second single-facer line expelling an air stream and conveying a second single-faced web towards the double backer.
Figure 10:
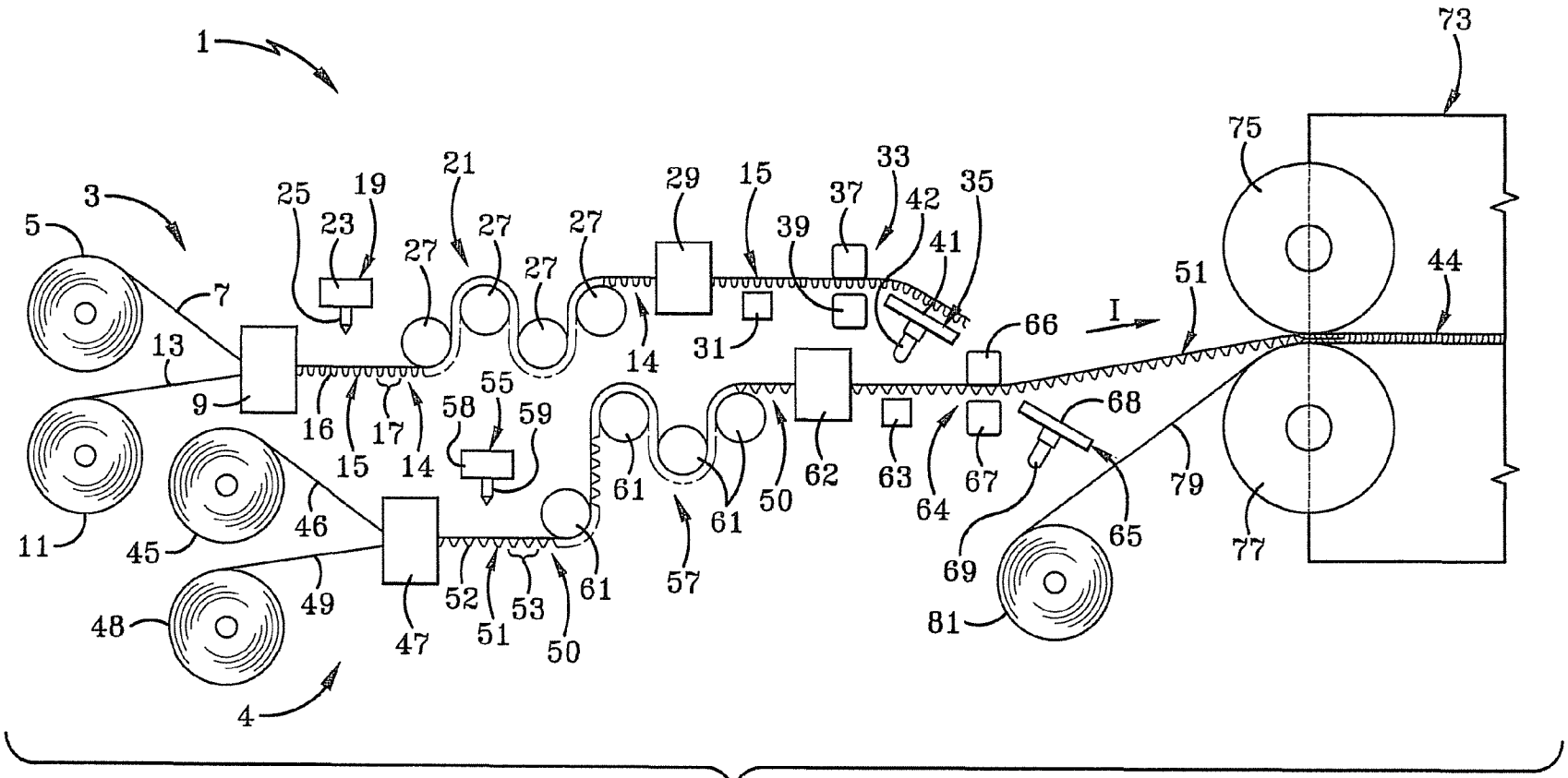
FIG. 10 is a view similar to FIG. 9 showing the second-single faced web engaging with the double backer.

As shown in FIGS. 7 and 8, the tension on first single-faced web 15 creates tear 93 generally between cut 85 and second edge 20, and the continued pulling on second portion 91 by double backer 73 advances second portion 91 away from first portion 89 (FIG. 8). As shown in FIG. 9, after first single-faced web 15 tears into first portion 89 and second portion 91, second clamp bar 39 moves in the direction of Arrow G to move clamp mechanism 33 from the closed position to the open position. Likewise, single facer 9 stops forming first single-faced web 15, and track 14 stops conveying first single-faced web 15. As first single facer line 3 stops and becomes inactive, first portion 89 is disposed over air table 35 (FIGS. 9-11). Thus, first single-faced web 15 is automatically separated from double backer 73 such that the need to manually separate first single-faced web 15 into two portions is eliminated.

At generally the same time first single facer line 3 is becoming inactive, second single facer line 4 is becoming active. FIGS. 9-11 show second single facer line 4 automatically conveying second single-faced web 51 into double backer 73 to produce corrugated material 83 having flute size 53. As shown in FIG. 6, second single-faced web 51 is disposed over air table 65. Single-facer 47 on second single facer line 4 starts to produce second single-faced web 51 and conveys second single-faced web 51 along track 50. At generally the same time, air table 65 blasts air stream 71 through openings 70, lifting second single-faced web 51 off air table 65 in the direction of Arrow H, as shown in FIG. 9. Openings 70 are formed in top surface 68 and are identical to openings 43, shown in FIGS. 7 and 8. Top surface 68 of air table 65 is disposed generally facing double backer 73 such that air stream 71 flowing out of openings 70 direct second single-faced web 51 towards double backer 73. The combined movement of track 50 conveying second single-faced web 51 along track 50 towards double backer 73, and air table 65 blasting air stream 71 such that second single-faced web 51 is lifted off track towards double backer 73, results in second single-faced web 51 being moved in the direction of Arrow I, directly into double backer 73.

As shown in FIG. 10, the rotational movement of first inlet roller 75 in the direction of Arrow J and second inlet roller 77 in the direction of Arrow K, cooperatively rotate inwardly relative double backer 73. Furthermore, material 79 is continuously being conveyed into double backer 73 such that material 79 essentially acts as a conveyer belt into double backer 73. As second single-faced web 51 is conveyed proximate double backer 73, first inlet roller 75 and second inlet roller 77, working in conjunction with material 79, lead second single-faced web 51 into double backer 73. As shown in FIG. 11, second single-faced web 51 is thereby pulled into double backer 73 wherein corrugated material 83 is formed having flute size 53. Thus, second single-faced web 51 is automatically inserted into double backer 73 such that the need to manually insert second single-faced web 51 into double backer 73 is eliminated, and the flute change sequence from flute size 17 to flute size 53 is complete.

Throughout the above described flute change process, double backer 73 is maintained at a constant speed which corresponds to the typical processing speed double backers use in the art to form corrugated material from a single-liner web.

The flute change process described herein is shown as changing from flute size 17 to flute size 53. It will be readily understood that to change from flute size 53 to flute size 17, the process is simply repeated with second single facer line 4 becoming inactive and first single facer line 3 becoming active. A user can readily change the flute size in the corrugation process without manually inserting a new single-faced web, and without slowing or stopping the corrugation process.

Water stream 26 is an important feature of the present invention because of the novel features inherent therein, particularly when used in the corrugation process. It will be readily understood in the art that the corrugation process can run at various line speeds depending on the particular job, such that first single-faced web 15 is conveyed past nozzle 25 at a wide range of different speeds. As such, there are substantial differences between water stream 26 and a blade-type cutting tool. A blade-type cutting tool must be synchronized with the line speed to direct the blade of the cutting tool into the passing single-faced web at precisely the angle to cut the single-faced web. If the blade is directed at the wrong angle, the force applied to the blade-type cutting tool by first single-faced web 15 will bend and break the cutting tool. Furthermore, the blade of the cutting tool will become dull over time and must be replaced, costing the user time and expense. Conversely, water stream 26 offers a 360° cutting capability and does not require synchronization with the line speed to ensure a cut. Furthermore, water stream 26 cannot dull or lose sharpness over time. Consequently, the water jet cutting device of the present invention is not structurally equivalent to a blade-type cutting tool.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus comprising:

a single backer machine adapted to form a single-faced web by securing a first backing material to a fluted material, wherein the single-faced web includes a leading edge;

a double backer machine adapted to form a corrugated material by securing a second backing material to the single-faced web;

an inlet disposed on the double backer for receiving the single-faced web;

a clamp disposed between the single backer and the double backer and movable between an open position and a closed position, wherein the single-faced web is free to move through the clamp when the clamp is in the open position and the single-faced web is prevented from moving through the clamp when the clamp is in the closed position;

an air table configured to selectively convey the leading edge of the single-faced web into the inlet by way of an air stream, wherein the air table is disposed between the clamp and the double backer; and a cutting device disposed between the single backer and the clamp, wherein the cutting device is adapted to form a cut in the single-faced web extending from a first edge and terminating prior to a second edge opposite the first edge.

2. The apparatus of claim 1, wherein the air table is non-parallel with respect to the single-faced web when the single-faced web is received by the double backer.

3. The apparatus of claim 2, further comprising a sensor disposed between the cutting device and the clamp, wherein the sensor is operatively connected to the clamp, and wherein the sensor actuates the clamp to move between the open position and closed position.

4. The apparatus of claim 3, wherein the cutting device is adapted to selectively expel a pressurized stream of water through the single-faced web to form the cut in the single-faced web.

5. The apparatus of claim 4, wherein the sensor actuates the clamp to move from the open position to the closed position when the sensor senses the cut pass thereby.

6. An apparatus comprising:

a single backer machine adapted to form a single-faced web by securing a first backing material to a fluted material, wherein the single-faced web includes a leading edge;

a double backer machine adapted to form a corrugated material by securing a second backing material to the single-faced web;

a clamp disposed between the single backer and the double backer and movable between an open position and a closed position, wherein the single-faced web is free to move through the clamp when the clamp is in the open position and the single-faced web is prevented from moving through the clamp when the clamp is in the closed position;

an air table configured to selectively convey the leading edge of the single-faced web into the double backer by way of an air stream, wherein the air table is disposed between the clamp and the double backer; and a water jet cutting device disposed between the single backer and the clamp, wherein the water jet cutting device is adapted to selectively expel a pressurized stream of water through the single-faced web to form a cut in the single-faced web, whereby the cut extends from a first edge and terminates prior to a second edge opposite the first edge.

7. The apparatus of claim 6, further comprising a cutting track, wherein the water jet cutting device is movable along the cutting track.

8. The apparatus of claim 7, wherein the single-faced web is conveyed towards the double-backer in a first direction, and wherein the water jet cutting device moves along the cutting track in a generally perpendicular direction to the first direction.

9. The apparatus of claim 8, wherein the air table is non-parallel with respect to the single-faced web when the single-faced web is received in the double backer.

10. The apparatus of claim 9, further comprising a sensor disposed between the water jet cutting device and the clamp, wherein the sensor is operatively connected to the clamp, and wherein the sensor actuates the clamp to move between the open position and closed position.

11. The apparatus of claim 10, further comprising:

an inlet disposed on the double backer for receiving the single-faced web; and wherein the air table is configured to selectively convey the leading edge of the single-faced web into the inlet by way of an air stream.

* * * * *